US008365670B2

(12) United States Patent
Abramov

(10) Patent No.: US 8,365,670 B2
(45) Date of Patent: Feb. 5, 2013

(54) DUAL MODE GRENADE

(76) Inventor: Igor Abramov, Oceanside, CA (US)

( * ) Notice: Subject to any disclaimer, the term of this patent is extended or adjusted under 35 U.S.C. 154(b) by 160 days.

(21) Appl. No.: 13/011,912

(22) Filed: Jan. 23, 2011

(65) Prior Publication Data

US 2012/0186481 A1 Jul. 26, 2012

Related U.S. Application Data

(60) Provisional application No. 61/297,822, filed on Jan. 25, 2010.

(51) Int. Cl.
*F42B 12/22* (2006.01)

(52) U.S. Cl. ..... 102/495; 102/482

(58) Field of Classification Search ..... 102/482, 102/489, 491, 494, 495, 502
See application file for complete search history.

(56) References Cited

U.S. PATENT DOCUMENTS

| | | | | |
|---|---|---|---|---|
| 3,448,688 | A * | 6/1969 | Sindermann | 102/482 |
| 4,781,118 | A * | 11/1988 | Assmann | 102/496 |
| 4,817,532 | A * | 4/1989 | Assmann | 102/482 |
| 8,136,437 | B2 * | 3/2012 | Van Stratum et al. | 86/1.1 |
| 2007/0266883 | A1 * | 11/2007 | Law et al. | 102/482 |
| 2008/0006171 | A1 * | 1/2008 | Confer | 102/497 |
| 2008/0092766 | A1 * | 4/2008 | Brunn | 102/498 |
| 2012/0192753 | A1 * | 8/2012 | Scheid et al. | 102/495 |

* cited by examiner

*Primary Examiner* — Gabriel Klein

(57) ABSTRACT

A dual mode grenade (2) is selectively operational in lethal and non-lethal modes. The grenade (2) contains a hard back (10) containing fuse/safing assembly (14), and the central explosive charge (12) surrounded respectively by non-lethal (N-L) projectiles (8), N-L case (6), and the removable lethal fragmentation shell (4). The grenade operates in lethal fragmentation mode when all its components are present and the fragmentation shell bursts into plurality of lethal projectiles (18). The N-L operation of the grenade is effected by the removal of the fragmentation shell (4) whereby N-L projectiles are allowed to eject outwards in response to the bursting of explosive charge (12).

12 Claims, 6 Drawing Sheets

DUAL MODE GRENADE

CROSS-REFERENCE TO RELATED APPLICATION

This application claims the benefit of Provisional Patent Application Ser. No. 61/297,822 filed 2010 Jan. 25 which is incorporated in its entirety therein.

FIELD OF INVENTION

This invention relates in general to grenades, in particular to fragmentation and non-lethal grenades, and more particularly to dual mode grenade selectively operational in lethal fragmentation or non-lethal modes.

BACKGROUND OF INVENTION

Modern warfare doctrines demand flexible response to threats. The Military Operations in Urban Terrain (MOUT) missions often require measured response to threats in order to minimize catastrophic and/or collateral damage to non-combatants. At the same time the protection of the military personnel is of paramount importance which sometimes necessitates the use of the lethal force. The response therefore sometimes calls for Non-Lethal (N-L) means of deterrence, while the ultimate protection is achieved through the use of conventional lethal weaponry, such as conventional grenades. The field deployment and use of both types of devices by the same personnel is problematic due to the increased weight load for the military field personnel and the necessity to operate in the field and logistically manage several types of grenades.

It is desirable, therefore to have a single device, such as a dual mode grenade, that could be operated selectively in an N-L or a lethal mode, depending on the tactical situation and particular mission goals.

It is also desirable to have a grenade which would be easily, quickly and reversibly transformed from one mode to another.

It is also desirable to have a device compatible with the intended operational, storage and logistics environments of the users.

It is also desirable to have a device which, when converted to N-L mode will not create or leave behind unused explosive components which can be exploited by adversaries.

OBJECTIVES OF THE INVENTION

Thus, it is an objective of instant invention to provide a dual mode grenade which would be selectively operable in a lethal as well as a non-lethal mode.

Another objective of instant invention is to provide a dual mode grenade which would be quickly and easily transformed from one operational mode to another.

Yet another objective of instant invention is to provide a dual mode grenade which would be reversibly switchable from one operational mode to another without any tools or implements.

Another objective of instant invention is to provide a dual mode grenade which would be compatible with the existing and intended operational, storage and logistics environments.

Yet another objective of instant invention is to provide a dual mode grenade which when converted to N-L mode would not leave behind components containing explosives.

SUMMARY OF THE INVENTION

In accordance with the present invention a dual mode grenade is presented. The grenade contains a hard back containing fuse/safing assembly, and the central explosive charge surrounded by concentric layers of, respectively, non-lethal (N-L) projectiles, N-L case, and the removable lethal fragmentation shell, both the N-L case and the fragmentation shell attached to the hard back. The activation of the grenade is effected by a fuse/safing assembly interfacing with the explosive charge.

PRIOR ART

Prior art contains grenades whose operation can be modified from a so-called 'offensive' (limited to an explosion blast, flash and sound) to a 'defensive' (explosion and fragmentation) operation. One such grenade is Model DM51 made by Diehl BGT Defence Gmbh & Co. of Überlingen, Germany. It features a hexagonal explosive fuse-containing core which can be used by itself in the offensive mode, that is, without fragmentation projectiles. For a defensive mode the core is inserted into- and locked inside a fragmentation shell containing a number of fragmentation projectiles. When the core explodes, the fragmentation projectiles are expelled.

Another offensive-defensive grenade, Model M5 is made by Explosivos Alaveses, S.A. of Madrid, Spain. Like the previous device, this grenade uses a fragmentation shell that is screwed onto a percussion offensive explosive core to convert it into a fragmentation-type defensive weapon.

None of the prior art teaches non-lethal mode capabilities for dual mode grenades, in addition to the fragmentation lethal mode.

OBJECTS AND ADVANTAGES

In contrast to the prior art mentioned hereinabove, the present invention provides a non-lethal operational mode in addition to a lethal fragmentation one. It provides a quick and easily reversible transformation from a lethal to a non-lethal mode of operation.

DESCRIPTION OF THE PREFERRED EMBODIMENT

In the foregoing description like components are referenced by the like numerals.

Figure 1:
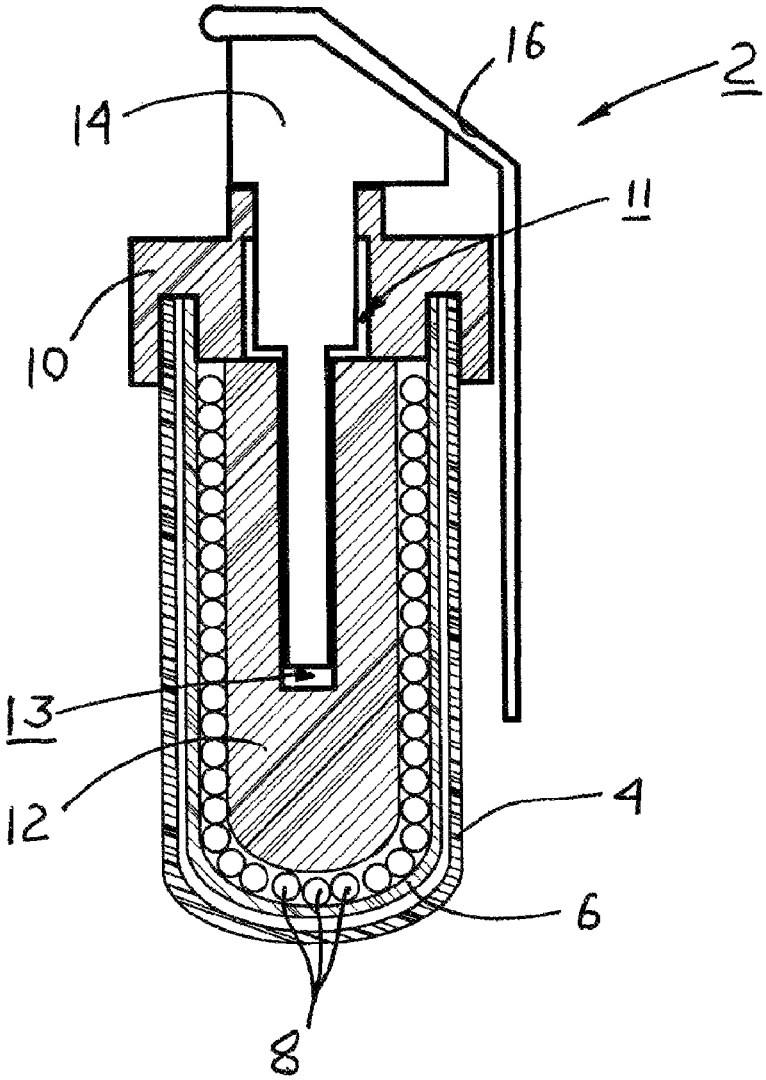
FIG. 1 is a cross section of the dual mode grenade of the instant invention.

The preferred embodiment 2 of the grenade is shown on FIG. 1. Fragmentation shell 4 and non-lethal case 6 are attached to hard back plate 10. Non-lethal case 6 contains a plurality of non-lethal projectiles 8. Explosive charge 12 containing cavity 13 is placed inside or cast into the assembly adjacent to non-lethal projectiles 8.

Fuse/safing assembly 14 is inserted via a threaded aperture 11 in hard back plate 10 into cavity 13 of explosive charge 12. Explosive charge is preferably of a high explosive-type, such as 'Composition B' consisting of a mix of TNT (trinitrotoluene) and RDX (cyclotrimethylenetrinitramine), or PETN (pentaerythritol tetranitrate), and the like. Explosives of this type are known in the art.

Fuse/safing assembly 14 contains safety clip 16 which prevents premature fuse activation prior to grenade release.

Non-lethal case 6 is made from a relatively soft material, preferably hard rubber, and is permanently attached to hard plate 10, while fragmentation shell 4 can be detached and re-attached to hard plate 10 repeatedly and at will. Fragmentation shell 4 is preferably made of a brittle material, or, alternatively of a case containing individual projectiles either embedded in or attached thereto. The attachment of non-lethal case 6 and fragmentation shell 4 to hard back plate 10 is preferably accomplished by threaded connections.

Operation

Figure 2:
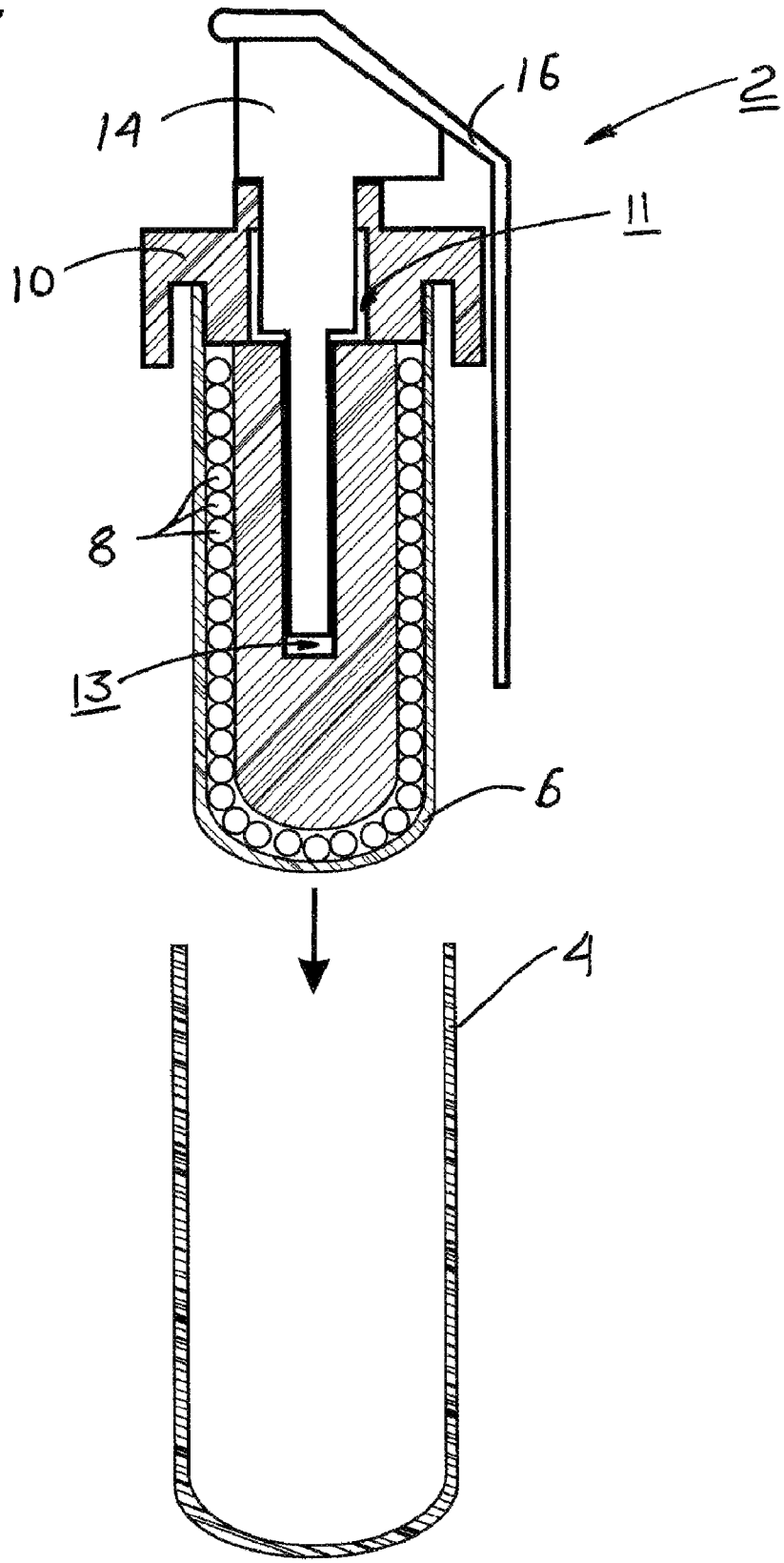
FIG. 2 is a cross section of the grenade illustrating removal of the outer fragmentation shell.
Figure 3:
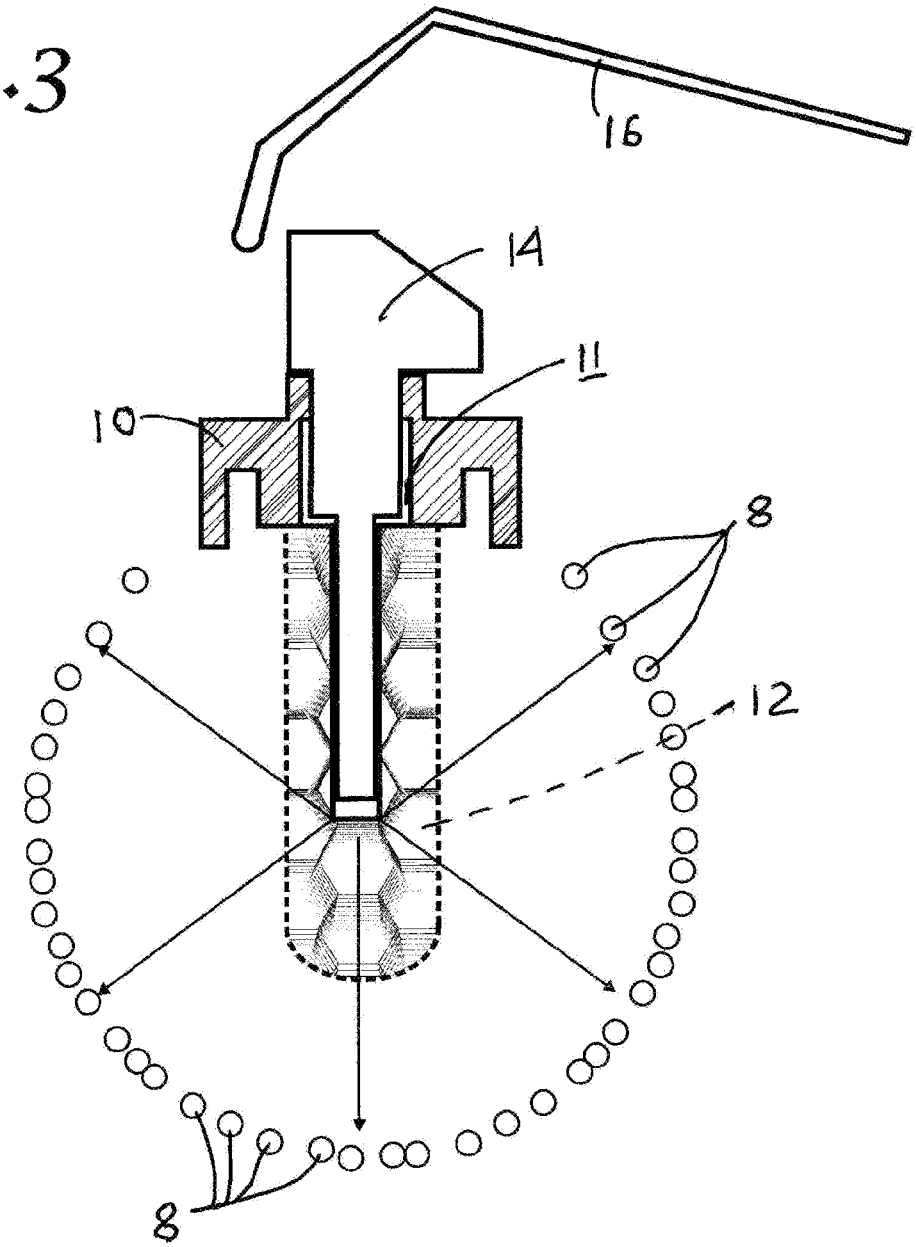
FIG. 3 is a cross section of the grenade illustrating its explosion without the fragmentation shell while ejecting non-lethal projectiles.

Referring to FIGS. 2 and 3, for non-lethal operation fragmentation shell 4 is detached from hard plate 10 prior to grenade activation. When grenade is released, safety clip 16 separates from the fuse/safing assembly 14 which then initiates the explosion of the explosive charge 12 which in turn expels non-lethal projectiles 8 through non-lethal case 6 outwards.

Figure 4:
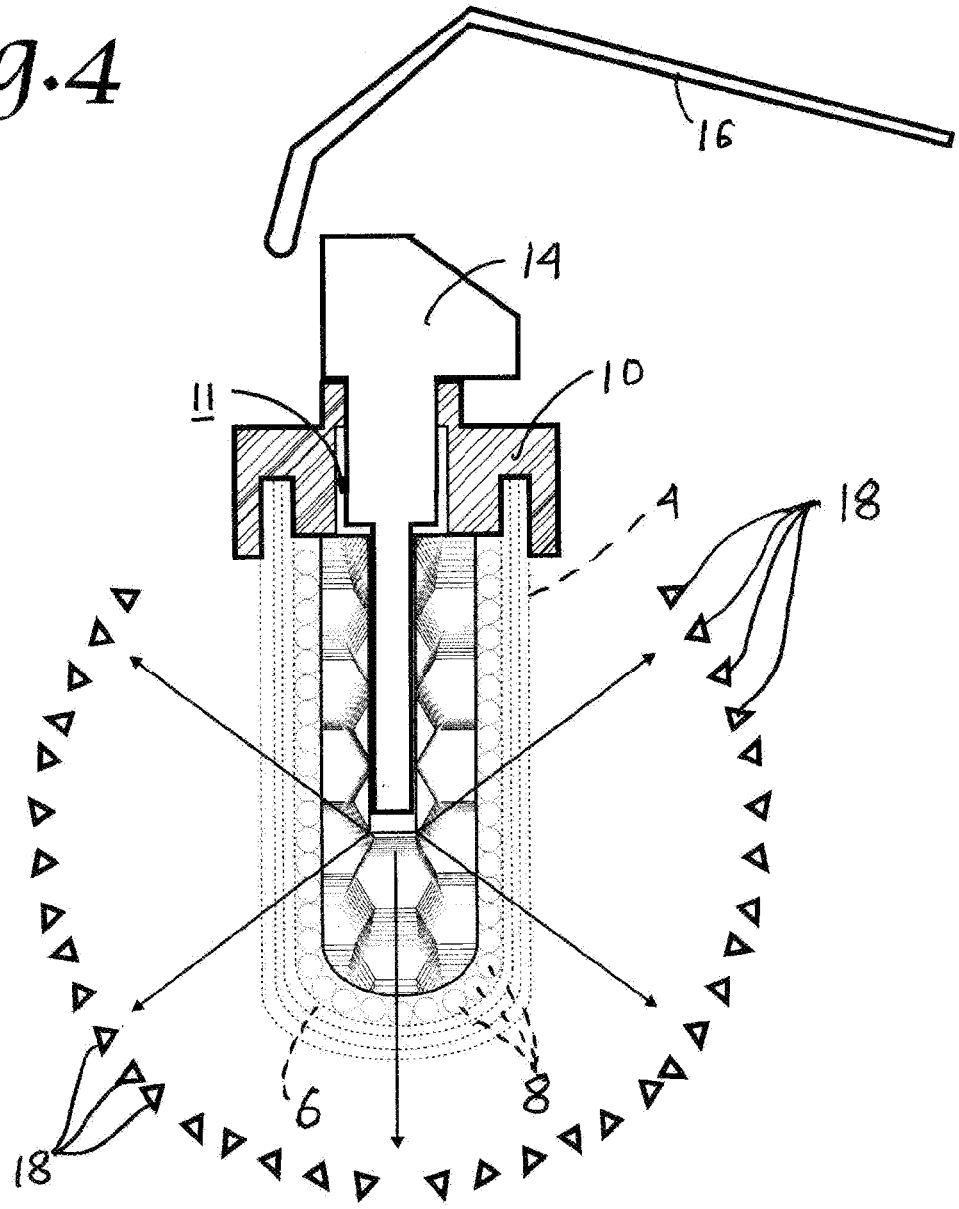
FIG. 4 is a cross section of the grenade illustrating its explosion with the fragmentation shell fragmenting into lethal projectiles.

For lethal operation fragmentation shell 4 is either left attached to the hard plate 10 or is re-attached to it, if it was previously detached. As shown on FIG. 4 when grenade is released safety clip 16 separates from fuse/safing assembly 14 which then initiates the explosion of explosive charge 12. The overpressure created by the constrained explosion of explosive charge 12 within the volume enclosed by hard plate 10 and fragmentation shell 4 fractures fragmentation shell 4 into a multitude of lethal fragments 18 which are expelled outwards. The non-lethal projectiles 8 and the non-lethal case 6 are consumed in the explosion.

Additional Embodiments

In the foregoing description like components are labeled with like numerals.

Figure 5:
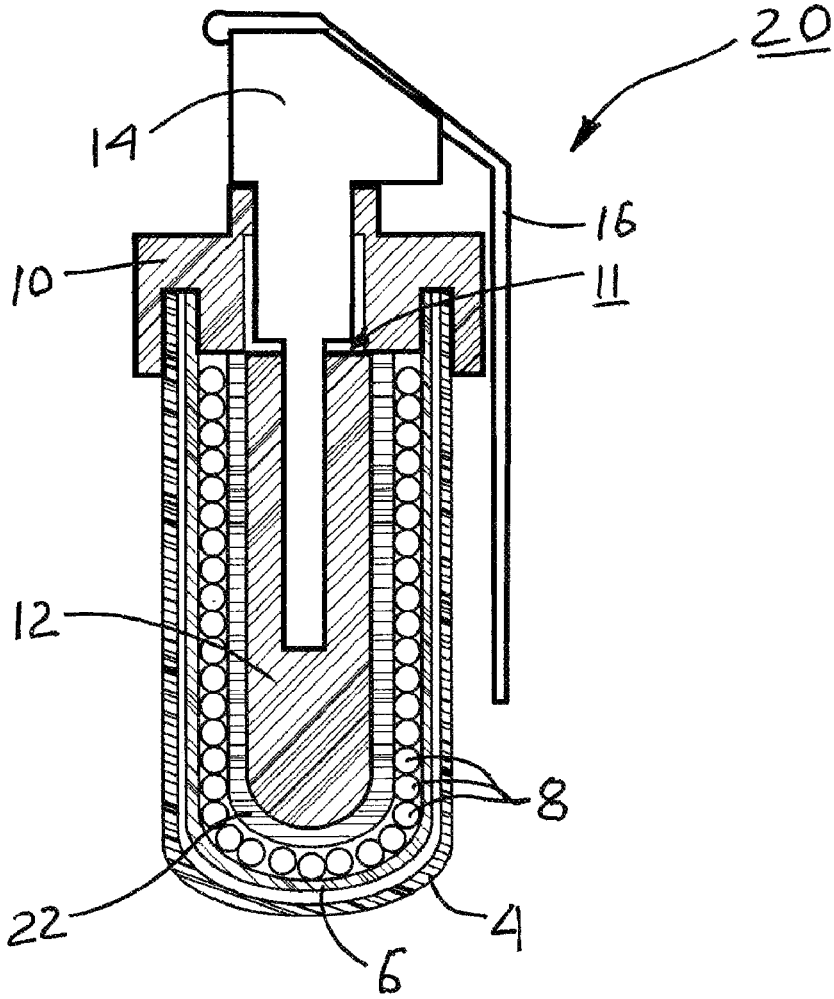
FIG. 5 is a cross section of the alternate embodiment of the grenade with dual explosive charge composition.

An alternate grenade embodiment 20 is shown on FIG. 5. In this embodiment the explosive charge consists of two parts. The inner explosive charge 12 can be similar to the one used in the preferred embodiment 2. The outer explosive charge 22 is used to shield non-lethal projectiles 8 from a potential damage from the explosion of high explosive charge 12 and then to eject them. To that effect charge 22 is made to have a composition which provides a propellant-type, 'slow' burning action, rather than detonation. Such compositions may include black powder, baratol, or a high explosive compound moderated with fillers or by adjusting its packing density, all well known in the art.

Figure 6:
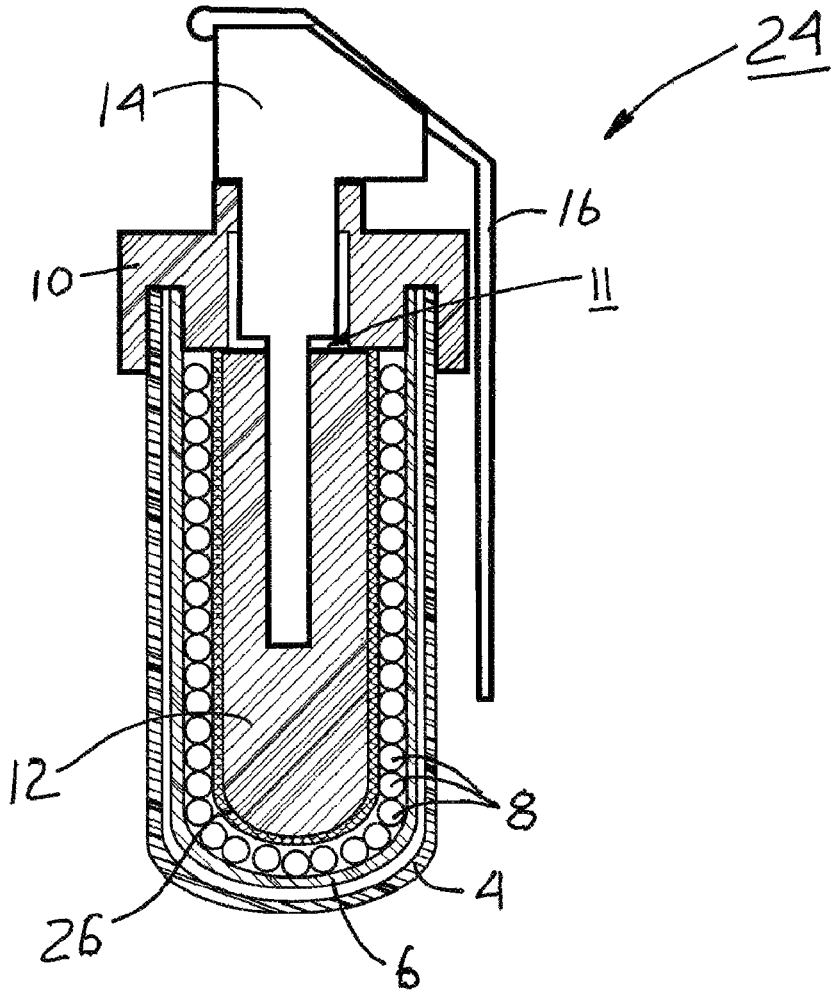
FIG. 6 is a cross section of the alternate embodiment of the grenade with a protective shell between high explosive and N-L projectiles.

An alternate grenade embodiment 24 is shown on FIG. 6. A protective shell 26 is added between high explosive 12 and non-lethal projectiles 8 to protect the latter from explosion charge 12 explosion during non-lethal operational mode.

The grenade and particularly its fragmentation shell 4 can be made somewhat conical in shape to enable nested storage of several shells when detached from grenades.

Non-lethal projectiles 8 can be made of hard rubber and other elastomers, such as silicones and fluoroelastomers, such as Viton® manufactured by E. I. du Pont de Nemours and Company. They can be made solid or hollow. If hollow, the N-L projectiles can also be made to contain irritants such as lachrymatory agents in gaseous and solid forms, and various compounds containing oleoresin capsicum (OC). Upon ejection from the grenade and impact on the targets the projectiles can be made to burst and release their content. Such projectiles are known in the art.

Protective shell 26 can be made of a relatively soft temperature-resistant material such as rubber, silicones, fluoroelastomers, or a thin ceramic- or carbon-fiber cloth.

Although descriptions provided above contain many specific details, they should not be construed as limiting the scope of the present invention. Thus, the scope of this invention should be determined from the appended claims and their legal equivalents.

I claim:

1. A dual mode grenade, said grenade selectively operable in lethal and non-lethal modes respectively, comprising:
- a hollow non-lethal case;
- an explosive charge;
- a hard back plate;
- a fuse assembly;
- at least one non-lethal projectile;
- a hollow lethal fragmentation shell;
- wherein said explosive charge is located inside said non-lethal case;
- wherein said non-lethal projectile or projectiles are positioned inside said non-lethal case between its inner wall and said explosive charge;
- wherein said non-lethal case is attached to said hard back plate;
- wherein said lethal fragmentation shell is removably placed over said non-lethal case;
- wherein said lethal fragmentation shell is further releasably attached to said hard back plate;
- wherein said fuse assembly is inserted into said hard back plate and enters the interior of said non-lethal case;
- wherein said fuse assembly engages said explosive charge;
- whereby upon activation said fuse assembly initiates explosion of said explosive charge;
- whereby lethal operation of said grenade is effected by retaining said fragmentation shell attached to said hard back plate and
- whereby said fragmentation shell disintegrates into plurality of lethal projectiles upon explosion of said explosive charge;
- whereby non-lethal operation of said grenade is effected by removing said fragmentation shell from said grenade and upon explosion of said explosive charge allowing said non-lethal case to burst and said non-lethal projectile or projectiles to eject outwards.

2. The grenade of claim 1 whereby said lethal fragmentation shell has an elongated frusto-conical shape to enable nesting of several said shells in one another when removed from said grenade.

3. The grenade of claim 1 wherein said non-lethal projectile or projectiles are made from elastomeric material.

4. The grenade of claim 1 wherein said non-lethal projectile or projectiles are hollow.

5. The grenade of claim 4 wherein said non-lethal projectile or projectiles are frangible upon striking external objects.

6. The grenade of claim 5 wherein said non-lethal projectile or projectiles contain irritating agents.

7. The grenade of claim 5 wherein said non-lethal projectile or projectiles contain malodorant agents.

8. The grenade of claim 1 further comprising a protective shell interposed between said explosive charge and said non-lethal projectile or projectiles.

9. The grenade of claim 8 wherein said protective shell comprises a refractory material refractory material.

10. The grenade of claim 8 further comprising propellant-type explosive.

11. The grenade of claim 1 wherein reversible conversion from said lethal and said non-lethal mode is effected without the use of tools or implements.

12. A method of effecting switchable lethal and non-lethal grenade operation comprising the steps of a) constructing a hollow non-lethal grenade case;

b) inserting explosive charge into said non-lethal case;

c) inserting at least one non-lethal projectile between the inner wall of said non-lethal case and said explosive charge;

c) attaching said case to a hard back plate;

d) inserting a fuse assembly into said hard back plate in a way that ensures its engagement of said explosive charge; e) removably placing a hollow lethal fragmentation shell over said non-lethal case and attaching said fragmentation shell to said hard back plate; f) selecting a mode of operation from the group consisting of non-lethal grenade operation and lethal grenade operation, and initiating the grenade based on the selected mode of operation; wherein:g) for non-lethal grenade operation: the lethal fragmentation shell is removed from the non-lethal case and hard back plate and fuse assembly is initiated causing said fuse assembly to initiate explosion of said explosive charge, and upon explosion of said explosive charge to causing said non-lethal case to burst and said non-lethal projectile or projectiles to be expelled outwards; and h) for lethal grenade operation: the hollow fragmentation shell is retained over the non-lethal case and the fuse assembly is initiated causing said fuse assembly to initiate explosion of said explosive charge; causing said lethal fragmentation shell upon explosion of said explosive charge to disintegrate into plurality of lethal projectiles.

* * * * *